US007249690B2

(12) United States Patent
Smith et al.

(10) Patent No.: US 7,249,690 B2
(45) Date of Patent: Jul. 31, 2007

(54) INDEPENDENT OFF-BOTTLE DISPENSING CLOSURE

(75) Inventors: Robert J Smith, Edinboro, PA (US); Ron J Walters, Columbus, PA (US)

(73) Assignee: Erie County Plastics Corporation, Corry, PA (US)

( * ) Notice: Subject to any disclaimer, the term of this patent is extended or adjusted under 35 U.S.C. 154(b) by 306 days.

(21) Appl. No.: 11/024,366

(22) Filed: Dec. 24, 2004

(65) Prior Publication Data

US 2006/0006192 A1 Jan. 12, 2006

(51) Int. Cl.
*B67D 5/00* (2006.01)

(52) U.S. Cl. ..... 222/83; 222/145.05; 222/153.05; 222/153.06; 222/153.09; 222/325; 222/541.2; 206/219; 206/222

(58) Field of Classification Search ..... 222/80–83, 222/145.5, 327, 153.06, 153.05, 153.09, 222/541.2, 325, 520–525, 541.9, 83.5, 86, 222/91; 206/219–222
See application file for complete search history.

(56) References Cited

U.S. PATENT DOCUMENTS 2,631,521 A 3/1953 Atkins, Jr.
2,859,898 A 11/1958 Mendenhall
3,156,369 A * 11/1964 Bowes et al. ..... 206/222
3,404,811 A * 10/1968 Cernei ..... 222/83
3,521,745 A 7/1970 Schwartzman
3,603,469 A 9/1971 Magni
3,655,035 A 4/1972 Muhlbauer
3,715,189 A 2/1973 Nighohossian et al.
3,841,467 A 10/1974 Hansen
3,968,872 A 7/1976 Cavazza
4,011,945 A 3/1977 Bourne et al.
4,195,731 A 4/1980 Cavazza
4,203,517 A * 5/1980 Hildebrandt et al. ..... 206/221
4,221,291 A 9/1980 Hunt
4,315,570 A 2/1982 Silver et al.
4,615,437 A 10/1986 Finke et al.
4,682,689 A * 7/1987 Pereira et al. ..... 206/222
4,693,366 A * 9/1987 Goncalves ..... 206/222
4,757,916 A * 7/1988 Goncalves ..... 222/83
4,776,972 A 10/1988 Barrett
4,805,799 A * 2/1989 Robbins, III ..... 366/348
4,858,759 A 8/1989 Mauthe et al.
4,858,760 A 8/1989 Di Sturco
4,898,293 A 2/1990 Morel
4,903,865 A 2/1990 Janowitz
4,982,875 A * 1/1991 Pozzi et al. ..... 222/83
5,029,718 A 7/1991 Rizzardi (Continued)

*Primary Examiner*—Frederick C. Nicolas
(74) *Attorney, Agent, or Firm*—BLK Law Group; Blynn L. Shideler; Krisanne Shideler

(57) ABSTRACT

A independent off bottle single use unit dosage dispensing closure includes a shell attached to a container, an axial movable cap attached to the shell, a sealing member coupled to the cap, and a removable retainer attached to the shell. The shell has an inner guide in communication with the container and the cap is moveable along the guide. The cap has a chamber adapted to dispense material into the container. The chamber is sealed with the sealing member extending across a lower open end thereof, wherein axial movement of the cap along the inner guide member will open the chamber and dispense the contents of the chamber into the container. The retainer prevents relative movement between the cap and the shell until the retainer has been removed.

19 Claims, 1 Drawing Sheet

U.S. PATENT DOCUMENTS 5,038,951 A 8/1991 Rizzardi
5,246,142 A 9/1993 DiPalma et al.
5,380,315 A * 1/1995 Isono et al. ..... 604/416
5,419,445 A 5/1995 Kaesemeyer
5,474,209 A * 12/1995 Vallet Mas et al. ..... 222/83
5,509,530 A 4/1996 Wilson
5,697,495 A 12/1997 Abrams et al.
5,772,017 A 6/1998 Kang
5,813,570 A * 9/1998 Fuchs et al. ..... 222/82
5,941,380 A 8/1999 Rothman
5,950,819 A 9/1999 Sellars
6,092,648 A 7/2000 Sellars
6,098,795 A 8/2000 Mollstam et al.
6,138,821 A 10/2000 Hsu
6,165,523 A 12/2000 Story
6,170,654 B1 1/2001 Gartner et al.
6,224,922 B1 5/2001 Fonte
6,305,576 B1 10/2001 Leoncavallo
6,372,270 B1 4/2002 Denny
6,820,740 B1 11/2004 Spector
6,935,493 B2 * 8/2005 Cho ..... 206/222
6,959,839 B2 * 11/2005 Roth et al. ..... 222/83
6,962,254 B2 11/2005 Spector
2003/0072850 A1 4/2003 Burniski
2004/0026270 A1 2/2004 Liang
2005/0218015 A1 10/2005 Spector

* cited by examiner

INDEPENDENT OFF-BOTTLE DISPENSING CLOSURE

BACKGROUND OF THE INVENTION

1. Field of the Invention

The present invention relates to cap dispensing closures for a container, more particularly to closures having a chamber in the cap that can selectively store and dispense the contents there-of into the container and in which the closure is designed for off bottle storage.

2. Prior Art

The broad concept of a container closure including a compartment for storing material separate from the container for selectively mixing with the container is very old and well known.

U.S. Pat. No. 3,521,745 discloses a container with two compartments and a piercing member used to rupture the wall between the compartments to allow the material stored in one compartment to mix with the material in the other.

U.S. Pat. No. 3,603,469 discloses a container closure having a cap that forms an interior chamber or reservoir for storing a substance. A reciprocating piercing member is used to rupture the reservoir to allow the material stored in the reservoir to mix with the material in the container.

U.S. Pat. No. 3,715,189 discloses a container with a completely open top (i.e. no neck finish) with a top cover that includes an interior chamber or reservoir for storing a substance. A plunger is used to rupture the reservoir to allow the material stored in the reservoir to mix with the material in the container.

U.S. Pat. No. 3,968,872 discloses a container closure having a cap that forms an interior chamber or reservoir for storing a substance. A piercing member is used to rupture the reservoir to allow the material stored in the reservoir to mix with the material in the container.

U.S. Pat. No. 4,195,731 discloses a container closure having a cap that forms an interior chamber or reservoir for storing a substance. A piercing piston is used to rupture the reservoir to allow the material stored in the reservoir to mix with the material in the container.

U.S. Pat. No. 4,221,291 discloses a container closure having a cap that forms an interior chamber or reservoir for storing a substance. A plunger or rod is connected to the bottom wall of the reservoir and is used to rupture the reservoir to allow the material stored in the reservoir to mix with the material in the container.

U.S. Pat. No. 4,615,437 discloses a threaded container closure or cap that forms an interior chamber or reservoir for storing a substance. A bottom wall of the reservoir is held in position by the bottle neck finish and further threading of the upper portion of the cap onto the bottle is used to rupture the reservoir to allow the material stored in the reservoir to mix with the material in the container.

U.S. Pat. No. 4,858,760 discloses a container closure having a cap that forms an interior chamber or reservoir for storing a substance. A bottom wall of the reservoir is ruptured by a piecing plunger to allow the material stored in the reservoir to mix with the material in the container.

U.S. Pat. No. 4,903,865 discloses a threaded container closure or cap that forms an interior chamber or reservoir for storing a substance. A bottom wall of the reservoir is held in position by the bottle neck finish and movement of a reciprocating plunger on the cap into the bottle is used to rupture the reservoir to allow the material stored in the reservoir to mix with the material in the container.

U.S. Pat. No. 5,029,718 discloses a container closure or cap that forms an interior chamber or reservoir for storing a substance. A bottom wall of the reservoir is held in position by the bottle neck finish and movement of a reciprocating plunger on the cap into the bottle is used to rupture the reservoir to allow the material stored in the reservoir to mix with the material in the container.

U.S. Pat. No. 5,038,951 discloses a container closure or cap that forms an interior chamber or reservoir for storing a substance. A bottom wall of the reservoir is held in position by the bottle neck finish and movement of a reciprocating plunger on the cap into the bottle is used to rupture the reservoir to allow the material stored in the reservoir to mix with the material in the container.

U.S. Pat. No. 5,772,017 discloses a threaded container closure or cap that forms an interior chamber or reservoir for storing a substance. A bottom wall of the reservoir is ruptured through movement of a threaded reciprocating piecing member on the cap to allow the material stored in the reservoir to mix with the material in the container.

U.S. Pat. No. 5,950,819 discloses a threaded container closure or cap that forms an interior chamber or reservoir for storing a substance. The reservoir is held in position by the bottle neck finish and movement of a top of the cap into the bottle is used to rupture the side walls of the reservoir to allow the material stored in the reservoir to mix with the material in the container.

U.S. Pat. No. 6,165,523 discloses a threaded container closure or cap that forms an interior chamber or reservoir for storing a substance. The reservoir is collapsible and has a piecing member for piercing the bottom wall thereof during compression to rupture the reservoir to allow the material stored in the reservoir to mix with the material in the container.

U.S. Pat. No. 6,224,922 discloses a container closure or cap that forms multiple colorants reservoirs for selectively dispensing into the container to selectively color the beverage in the container.

U.S. Pat. No. 6,305,576 discloses a threaded container closure or cap that forms an "aseptic" interior chamber or reservoir for storing a substance. A bottom wall of the reservoir is pieced by a movement of a reciprocating piercing member to allow the material stored in the reservoir to mix with the material in the container.

U.S. Pat. No. 6,372,270 discloses a container closure or cap that forms an interior chamber or reservoir for storing a substance. A bottom wall of the reservoir is ruptured by movement of a reciprocating plunger on the cap into the bottle to allow the material stored in the reservoir to mix with the material in the container.

As noted above wide variety of cap dispensing, or cap ejecting, closures are known in the art. The prior art devices have not been designed for off-bottle storage. Certain commercial applications would benefit from the distribution of closure separate from the container to which they will be attached when finally used (e.g. the consumer attaches the container closure to a bottle of water after purchase of the independent container closure). Further, many of these prior art designs are impractical from a standpoint of filling the chamber or reservoir in the closure.

It is an object of the present invention to overcome the drawbacks of the prior art and provide an economical independent off-bottle dispensing closure which is easily filled and has a long shelf life.

SUMMARY OF THE INVENTION

The above objects are achieved with a single use unit dosage dispensing closure according to the present invention. The independent closure according to the invention includes a shell adapted to be attached to a container, an axial movable cap attached to the shell, a sealing member coupled to the cap and a removable retainer secured to the cap before usage. The shell has an inner guide with an open end in communication with the container and the cap is moveable along the inner guide. The cap is axially movable along the inner guide. The cap has a chamber adapted to hold a unit dosage of material to be dispensed into the container. The chamber is sealed with the sealing member extending across a lower open end of the cap, wherein axial movement of the cap along the inner guide will pierce or otherwise remove the sealing member to dispense the contents of the chamber into the container after the closure has been attached to the container and the retainer has been removed from the cap.

The cap may be formed from polyethylene terephthalate, nylon, polypropylene with low shrink filler, or polyethylene with low shrink filler. The low shrink filler may be talc or mica, and the shell may be formed of a polyolefin material.

The shell may have an outer skirt with a closure attaching mechanism, such as a thread, on the outer skirt for attaching the shell to the container. A tamper evident band can be placed on a lower end of the outer skirt, however the retainer will also acts as a tamper evident band around the cap to prevent premature dispensing of the contents of the chamber.

The shell may further include a piercing element, wherein axial movement of the cap along the inner guide member will cause the piercing element to pierce the sealing film and dispense the contents of the chamber into the container. The piercing element may include a plurality of angled radial blades at a lower end of the inner guide, wherein the radial blades converge to form a piercing tip extending toward the upper end of the inner guide. Further, the invention may include folding elements to move the sealing member out of the way to further assist in dispensing.

The inner guide may be an annular tube having an annular seal engaging and sealing against the cap. The cap may have a top and a cylindrical side member forming the chamber.

One embodiment of the present invention forms the retainer as a separate piece from the cap with a raised gripping member and formed with a weakened or scored portion to form a tear away structure. Another modification may form the retainer integrally with the cap.

These and other advantages of the present invention will be clarified in the brief description of the preferred embodiment in connection with the attached figures in which like reference numerals represent like elements throughout.

DESCRIPTION OF THE PREFERRED EMBODIMENTS

Figure 1:
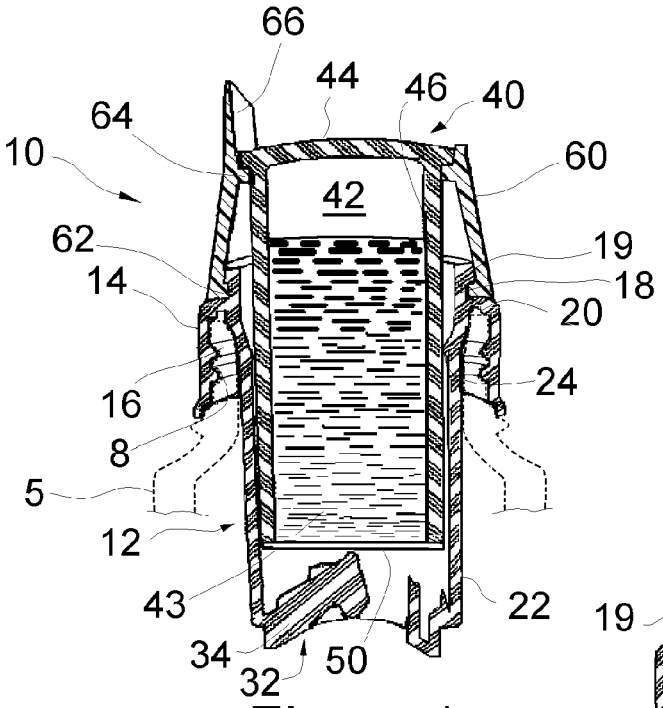
FIG. 1 is a sectional schematic view of an independent off bottle container closure according to the present invention.

An independent off bottle single use unit dosage dispensing closure 10 according to the present invention is shown in the figures. The closure 10 is adapted to be attached to a container 5(shown in figure 1 in phantom) with a threaded neck 8 finish (e.g. a bottle). The terms "independent" and "off bottle" are used herein to indicate that the closure 10 is designed for off-bottle storage and distribution (e.g. the closure 10 may be sold to the consuming public independent of the bottle, wherein the consumer attaches the closure 10 to a bottle, such as a bottle of water, then dispenses the contents of the closure 10 into the bottle). The closure 10 may actually be sold on the bottle or container 5 as well.

The closure includes a shell 12, which is adapted to be attached to the container, the shell 12 having an outer skirt 14. A closure attaching mechanism, in the form of threads 16, is on the outer skirt 14 for attaching the shell 12 to the container. If not intended for off-bottle use, the lower portion of the skirt 14 may be formed to include a tamper evident band, as is known in the art. The inner surface of the skirt may include a sealing ring 20 for sealing against the neck finish of the container. The shell 12 includes a retaining ring 18 with bead 19, as shown in the figure.

The shell 12 has a tubular inner guide 22 with an open lower end that will be in communication with the interior of the container once the closure 10 is attached to a container. The inner guide 22 includes at least one sealing ring 24 and has an open upper end thereof for access above the seal ring 24. The shell 12 may further include an alignment nub on the exterior of the guide 22 for alignment of the guide during manufacturing.

A piercing element 32 is formed integral with the inner guide 22. The piercing element 32 is formed a plurality of angled radial blades 34 at a lower end of the inner guide 22, wherein the radial blades 34 converge to form a piercing tip extending toward the upper end of the inner guide 22. Only one blade 34 is shown, but typically three such blades 34 are equally spaced about the lower end of the guide 22. Any plural number of blades may be used. The triangular center piercing tip (three blades 34) gives a center point for gating of the shell 12. Adjacent the blades 34 are folding elements 36 that are adapted to engage and fold back a sealing element to facilitate discharge of the unit dosage as will be described. Other piecing element designs or seal removing members can also be used as desired. The key functional feature is that the seal is ruptured or removed upon axial movement of the cap to dispense the contents thereof.

An important aspect of the present invention is that all of the major seals, undercuts and other "jump" features (i.e. elements that effectively deform slightly in the de-molding process) may be formed in or integral with the shell 12. The shell is made of a polymer that accommodates such features, such as polyolefin. Materials that accommodate these jump features do not have significant moisture or gas barrier properties (i.e. high moisture and gas permeability).

An axial movable cap 40 is attached to the shell 12 and moveable along the inner guide 22. The cap 40 defines an inner chamber 42 therein adapted to hold a unit dosage of material 43 to be dispensed into the container. The cap 40 is of a relatively simple configuration having a top 44 and a cylindrical side member 46 forming the chamber 42. The cap 40 may include a locking groove beneath the top 44 to further lock the cap 40 to the retainer, but such a groove is not preferred in the present design. If locking groove is omitted, or is formed after molding, then the simple construction (no jump features) of the cap 40 allows a relatively rigid material to be used to form the cap 40, whereby the cap 40 and the shell 12 may be made from different polymer materials. In other words, the axial movable cap 40 could be formed from a material with a higher oxygen and water barrier property than the material forming the shell 12. With the simple construction as shown, the cap 40 may be formed a rigid material such as polyethylene terephthalate (PET), nylon, polypropylene (PP) with low shrink filler, and polyethylene (PE) with low shrink filler. Low shrink fillers include talc and mica.

A sealing layer, or even film or foil member, 50 is coupled to the cap 40 at least prior to dispensing with the cap 40, wherein the chamber 42 is sealed with the sealing layer 50 extending across a lower open end of the cap 40 at the open end of the cylindrical side member 46. Axial movement of the cap 40 along the inner guide 22 will cause the piercing element formed by blades 34 to pierce the sealing layer 50 and dispense the contents of the chamber 42 into the container. Following the piercing of the layer 50, the folding elements 36 engage the distinct pieces of the sealing layer and move them out of the way to further assist in the dispensing. The layer 50 may be a metallic foil or a plastic film. The sealing ring 24 of the guide 22 engages and seals against the cylindrical side member 46.

Figure 2:
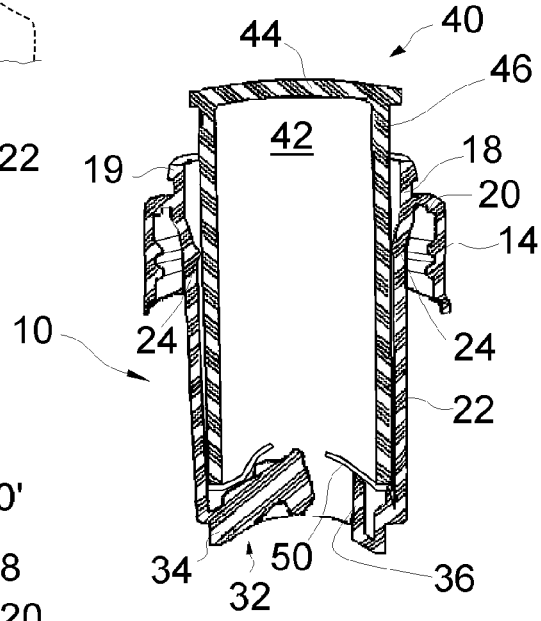
FIG. 2 is a sectional view of the container closure of FIG. 1 in a dispensing position.

The closure additionally includes a retainer 60 shown in FIG. 1. The retainer 60 is an annular member with a lower bead or ridge 62 engaging the bead 19 of the retaining member 18. The annular retainer 60 has an upper ridge 64 engaging the cap 40 below the ridge of the top 44 as shown in FIG. 1, whereby when the retainer is attached to the closure 10 the cap 40 cannot be moved relative to the shell 12. The ridge 64 and top 44 abutment prevents downward movement of the cap 40 relative to the shell 12 and the encapsulation of the cap 40 by the shell 12 at the opposite end of the cap (the end having the seal 50) prevents any upward force from moving the cap 40 while friction will hold the cap 40 from moving upward as well. The retainer 60 may have an upper ridge (not shown) above the top 44 to physically lock the cap in place in both axial directions, if desired. The retainer 60 includes an upwardly extending gripping member 66, and may have a weakened or scored portion extending along its length (i.e. from the upper edge with ridge 64 to the lower edge with ridge 62) such that the retainer 60 is formed as a tear away band. The retainer 60 is removed prior to actuation of the dispensing closure 10 as shown in FIG. 2 and further acts as a tamper evident band for security. The addition of the protective wrap over the entire closure 10 may also be provided as known in the art.

Figure 3:
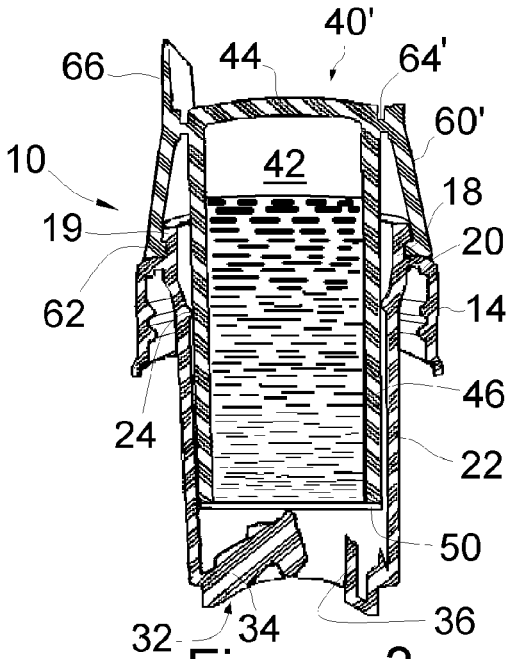
FIG. 3 is a sectional schematic view of an independent off-bottle container closure according to a modified embodiment of the present invention.

FIG. 3 shows a modified closure 10 in which the retainer 60' is formed integral with the cap 40' with ridge 64 replaced by a weakened score line 64' between the retainer 60' and the top 44 of cap 40'. The score line 64' together with the weakened or scored portion extending along its length from the upper edge adjacent score line 64' to the lower edge with ridge 62 allows the retainer 60' to act as a tear away band. Again the addition of the protective wrap over the entire closure 10 may also be provided for off-bottle sales of the container. The cap 40' with integral retainer 60' has more complex shape, such that this embodiment would be formed as a material similar to the shell (i.e. the more rigid material could not be used for this embodiment).

There are numerous variations of the concepts included in the closure of the present invention, although the above described embodiments are the most preferred and believed to offer the most advantages in manufacturing and operation. The scope of the present invention is intended to be defined by the appended claims and equivalents thereof.

What is claimed is:

1. An independent single use unit dosage dispensing closure comprising:

a shell attached to a container, the shell having an outer skirt with a closure attaching mechanism on the outer skirt for attaching the shell to the container, the shell having an inner guide, wherein the inner guide is an annular tube having at least one annular seal;

an axial movable cap attached to the shell and moveable along the inner guide, the cap having a chamber therein holding a unit dosage of material to be dispensed into the container, wherein each annular seal is engaging and sealing against the cap throughout movement of the cap;

a sealing layer coupled to the cap, wherein the chamber is sealed with the sealing layer extending across a lower open end of the cap, wherein axial movement of the cap along the inner guide will cause the sealing layer to rupture or be removed to dispense contents of the chamber into the container; and a retainer removeably secured to the cap and the shell preventing relative movement between the cap and the shell until the retainer has been removed.

2. The closure of claim 1 wherein the cap and the shell are made from different polymer materials.

3. The closure of claim 2 wherein the shell is formed of a polyolefin material.

4. The closure of claim 1 wherein the closure attaching mechanism on the outer skirt for attaching the shell to the container are threads.

5. The closure of claim 1 wherein the retainer is formed integral with the cap.

6. The closure of claim 1 wherein the retainer has a gripping member and is formed as a tear away band.

7. The closure of claim 1 wherein the cap has a top and a cylindrical side member forming the chamber.

8. An off bottle, independent single use unit dosage dispensing closure comprising:

a shell attached to a container, the shell having an inner guide with an open end in communication with the container, wherein the inner guide is an annular tube having at least one annular seal;

an axial movable cap attached to the shell and moveable along the inner guide, the cap engaging the inner guide and having a chamber therein holding a unit dosage of material to be dispensed into the container, wherein each annular seal is engaging and sealing against the cap throughout movement of the cap;

a sealing member coupled to the cap, wherein the chamber is sealed with the sealing member extending across a lower open end of the chamber, wherein axial movement of the cap along the inner guide member will dispense contents of the chamber into the container; and a retainer removably attached to the shell and the cap, wherein the retainer prevents relative movement between the cap and the shell until the retainer is removed from the shell.

9. The closure of claim 8 wherein the shell has an outer skirt with a closure attaching mechanism on the outer skirt for attaching the shell to the container.

10. The closure of claim 8 wherein the retainer is integral with the cap.

11. The closure of claim 8 wherein the shell includes an outer skirt having a closure attaching mechanism on the outer skirt for attaching the shell to the container in the form of threads.

12. An independent single use unit dosage dispensing closure comprising:

a shell attached to a container, the shell having an outer skirt with an open lower end receiving a portion of the container therein and a closure attaching mechanism on the outer skirt for attaching the shell to the container, the shell having an inner guide positioned in a radial inward position relative to the outer skirt and extending axially beyond the open lower end of the outer skirt;

an axial movable cap attached to the shell and moveable along the inner guide, the cap having a chamber therein holding a unit dosage of material to be dispensed into the container;

a sealing layer coupled to the cap, wherein the chamber is sealed with sealing layer extending across a lower open end of the cap, wherein axial movement of the cap along the inner guide will cause the sealing layer to rupture or be removed to dispense contents of the chamber into the container; and a retainer removeably secured to the cap and the shell preventing relative movement between the cap and the shell until the retainer has been removed.

13. The closure of claim 12 wherein the cap and the shell are made from different polymer materials.

14. The closure of claim 13 wherein the shell is formed of a polyolefin material.

15. The closure of claim 12 wherein the closure attaching mechanism on the outer skirt for attaching the shell to the container are threads.

16. The closure of claim 12 wherein the inner guide is an annular tube having at least one annular seal.

17. The closure of claim 12 wherein the retainer is formed integral with the cap.

18. The closure of claim 12 wherein the retainer has a gripping member and is formed as a tear away band.

19. The closure of claim 12 wherein the cap has a top and a cylindrical side member forming the chamber.

* * * * *